US007419241B2

(12) United States Patent
Kawashima et al.

(10) Patent No.: US 7,419,241 B2
(45) Date of Patent: Sep. 2, 2008

(54) IMAGE FORMING APPARATUS

(75) Inventors: Yasuhiro Kawashima, Kanagawa (JP); Masatoshi Sakakitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 388 days.

(21) Appl. No.: 11/354,487

(22) Filed: Feb. 14, 2006

(65) Prior Publication Data

US 2006/0181569 A1 Aug. 17, 2006

(30) Foreign Application Priority Data

Feb. 16, 2005 (JP) ..... 2005-038703

(51) Int. Cl.
*B41J 2/165* (2006.01)

(52) U.S. Cl. ..... 347/36; 347/35

(58) Field of Classification Search ..... 347/36, 347/31, 35, 51, 100, 29, 33
See application file for complete search history.

(56) References Cited

U.S. PATENT DOCUMENTS 6,082,848 A * 7/2000 Taylor ..... 347/35
6,168,258 B1 * 1/2001 Lou et al. ..... 347/33
6,322,196 B1 * 11/2001 Lim ..... 347/35
6,357,853 B1 * 3/2002 Askren et al. ..... 347/36
6,561,619 B1 * 5/2003 Shibata et al. ..... 347/33
6,776,472 B2 * 8/2004 Itano et al. ..... 347/35

FOREIGN PATENT DOCUMENTS

JP 6-340092 12/1994
JP 2000-85143 3/2000
JP 2000-203059 7/2000

* cited by examiner

*Primary Examiner*—Shih-wen Hsieh
(74) *Attorney, Agent, or Firm*—Cooper & Dunham, LLP

(57) ABSTRACT

An image forming apparatus including a head part with an ejection port configured to eject ink, a discarded-ink tank configured to collect ejected or absorbed ink in order to restore a function of the ejection port, and a sensing device configured to sense the discarded ink collected in the discarded-ink tank, the sensing device including an absorber configured to absorb the ink and an optical sensor configured to sense the light received from the absorber is disclosed, wherein the apparatus uses ink having a characteristic such that the discarded ink is accumulated in a mountain-like shape in the discarded-ink tank, and the absorber is arranged at the location, at which discarded ink can be absorbed when a mountain top of the discarded ink accumulated in a mountain-like shape reaches a predetermined height so that the discarded ink flows along a slope of the discarded ink accumulated in a mountain-like shape to the absorber.

7 Claims, 11 Drawing Sheets

IMAGE FORMING APPARATUS

BACKGROUND OF THE INVENTION

1. Field of the Invention

The present invention relates to an image forming apparatus.

2. Description of the Related Art

Conventionally, an ink jet printer is known as an image forming apparatus for forming an image on a recording medium by ejecting ink drops from the ejection port of an ink head. The ink jet printer is provided with an aspirating mechanism such as an aspirating pump for aspirating ink with an ink viscosity increased by the evaporation of ink solvent at the ejection port of the head or dirt adhered to the ejection port together with the ink. Also, blank ejection to a blank ejection receiver is performed in order to adjust the viscosity of ink and an ink meniscus before the start of printing. Ink aspirated by the aspirating pump or ink blank-ejected onto the blank ejection receiver is collected in a discarded-ink tank.

When a predetermined amount of ink is collected in the discarded-ink tank, the discarded-ink tank is detached from the main body of the apparatus and replaced with a new discarded-ink tank. For example, JP-A-2000-85413 discloses a discarded ink collecting apparatus that senses by an optical sensor and informs a user whether a predetermined amount of ink is collected in a discarded-ink tank. The discarded ink collecting apparatus disclosed in JP-A-2000-85413 is provided with an inflow port for discarded ink at one end portion of the upper wall of the discarded-ink tank and a sensor window at the other end portion. Then, the bottom portion of the sensor window is provided with a white sponge and an optical sensor for sensing light reflected from the sponge. As the discarded-ink tank is filled with the discarded ink, the white sponge provided on the bottom portion of the sensor window absorbs the discarded ink and the color thereof is changed into black whereby the light reflectivity of the sponge becomes a predetermined value or less. As a result, little reflected light enters the optical sensor and it can be sensed that the discarded-ink tank is filled with the discarded ink.

Meanwhile, a water-based ink that contains a pigment and a solvent in which a wetting agent (humectant), a penetrating agent and the like are contained in water is currently being used for printing with satisfactory properties of an image such as a color reproduction property, a fastness property, a light fastness property, an ink drying property, character bleeding, color border bleeding, and a double face printing property, etc., when printing is made on a normal paper.

However, such a pigment-containing ink has a viscosity higher than that of a general dye-containing ink and it takes less time to evaporate the solvent component of the pigment-containing ink so as to reach a viscosity showing the loss of the ink fluidity. Therefore, the discarded ink in the discarded-ink tank has a viscosity showing no fluidity. Also, since it takes less time to evaporate the solvent component of the pigment-containing ink so as to reach a viscosity showing the loss of the ink fluidity, the solvent component may have evaporated to reach a viscosity showing the loss of the fluidity under a high temperature or low humidity environment when the ink is dropped into the discarded-ink tank. Thus, the ink which has reached the viscosity that shows the loss of the fluidity at a stage of dropping the ink into the discarded-ink tank adheres to the discarded ink in the discarded-ink tank as agglomerate. The ink adhering to and deposited to the discarded ink as agglomerate in the discarded-ink tank increases with time. As a result, the discarded ink is not evenly collected in height in the discarded-ink tank but is accumulated in a mountain-like shape such that the top of the mountain is located at the discarded-ink entrance of the discarded-ink tank. Thus, although there is space enough to collect the discarded ink at the end portions of the discarded-ink tank away from the ink entrance thereof, the discarded ink protrudes from the entrance of the discarded-ink tank since the discarded ink is accumulated in a mountain-like shape. When the discarded-ink tank is exchanged on the condition that the discarded ink protrudes from the entrance of the discarded-ink tank, there is a problem in that the circumference of the ink tank in the apparatus is contaminated with the protruded discarded-ink. Also, there is a problem in that the protruded ink clogs the entrance of the discarded-ink tank so that the discarded ink is poured onto the outside of the discarded-ink tank.

However, where a sensing device is provided at the end portion of the discarded-ink tank which is away from the ink entrance on the upper wall thereof, as disclosed in JP-A-2000-85143, a condition cannot be sensed such that the discarded ink does not adhere to the sponge but protrudes from the ink entrance of the discarded-ink tank.

Therefore, an image forming apparatus that can suppress the protrusion of discarded ink from the entrance of a discarded-ink tank is desired.

SUMMARY OF THE INVENTION

The present invention solves one or more of the above problems.

According to one aspect of the invention, there is provided an image forming apparatus including a head part with an ejection port configured to eject ink, a discarded-ink tank configured to collect ejected or absorbed ink in order to restore a function of the ejection port, and a sensing device configured to sense the discarded ink collected in the discarded-ink tank, the sensing device including an absorber configured to absorb the ink and an optical sensor configured to sense light from the absorber, wherein the apparatus uses ink having a characteristic such that the discarded ink is accumulated in a mountain-like shape in the discarded-ink tank, and the absorber is arranged at the location, at which discarded ink can be absorbed when a mountain top of the discarded ink accumulated in a mountain-like shape reaches a predetermined height so that the discarded ink flows along a slope of the discarded ink accumulated in a mountain-like shape to the absorber.

BRIEF DESCRIPTION OF THE DRAWINGS

The present invention will become more apparent from the following detailed description when read in conjunction with the accompanying drawings, in which.

DETAILED DESCRIPTION OF THE PREFERRED EMBODIMENTS

Figure 1:
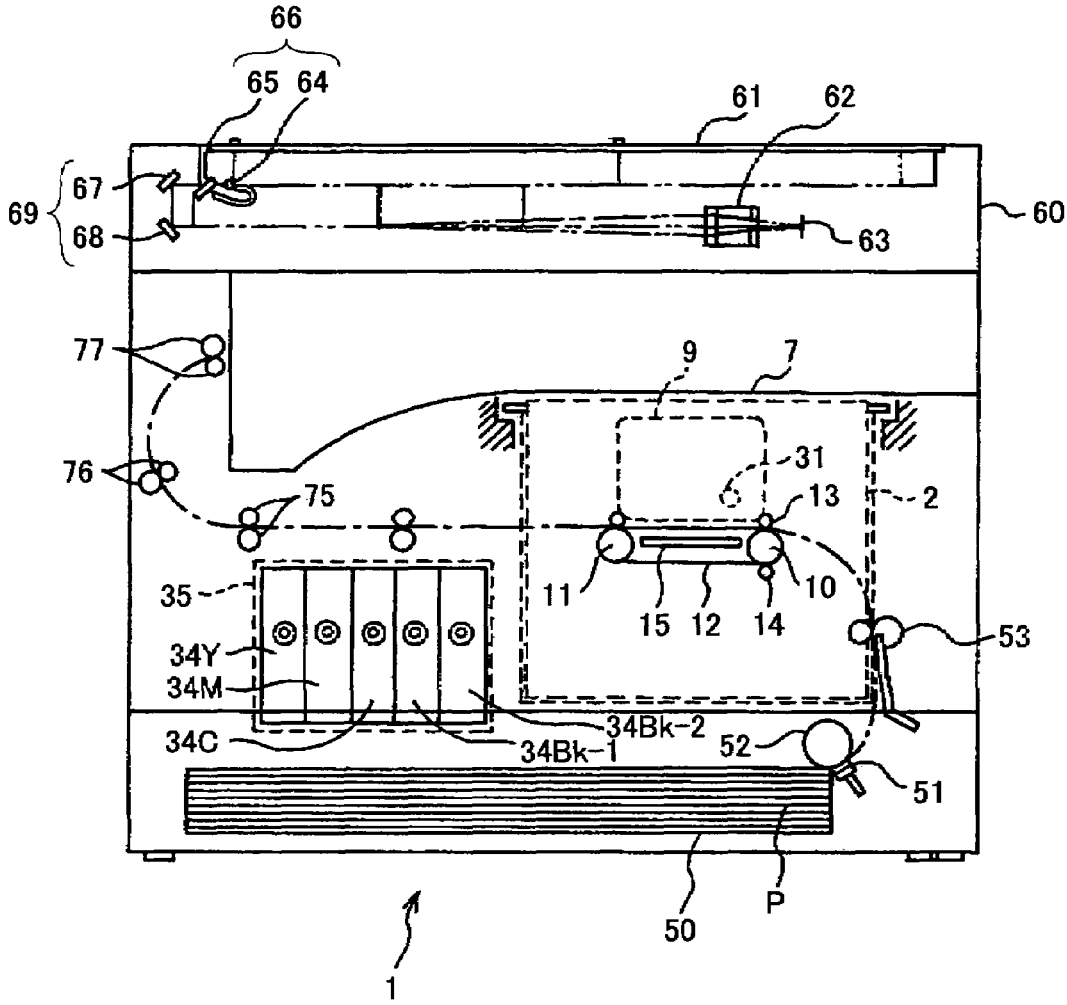
FIG. 1 is a front view showing the general structure of an image forming apparatus.

More specifically, the first embodiment of the present invention is an image forming apparatus including a head part with an ejection port configured to eject ink and a discarded-ink tank configured to collect ejected or absorbed ink in order to restore a function of the ejection port and using ink such that discarded ink is accumulated in a mountain-like shape in the discarded-ink tank, wherein the apparatus includes a sensing device configured to sense the discarded ink collected in the discarded-ink tank, which sensing device includes an absorber configured to absorb the ink and an optical sensor configured to sense light from the absorber, and the absorber is arranged at a location at which discarded ink can be absorbed which falls in the discarded-ink tank and flows along a slope of the discarded ink accumulated in a mountain-like shape when a mountain top of the discarded ink accumulated in a mountain-like shape in the discarded-ink tank reaches a predetermined height.

According to the first embodiment of the present invention, the image forming apparatus can sense that the height of the mountain top of discarded ink deposited so as to be built up near an aperture of the discarded-ink tank reaches the predetermine height. Therefore, on the condition that the mountain top of the discarded ink in the discarded-ink tank does not protrude from the discarded-ink entrance of the discarded-ink tank, if the absorber is arranged at the location at which ink falling in the discarded-ink tank and flowing along the slope of the discarded ink can be absorbed, the discarded-ink tank can be exchanged before the mountain top of the discarded ink in the discarded-ink tank protrudes from the discarded-ink entrance of the discarded-ink tank. As a result, the contamination of the apparatus and the pouring of the discarded ink on the outside of the discarded-ink tank can be suppressed when the discarded-ink tank is exchanged.

In the image forming apparatus as described above, preferably, the optical sensor senses light reflected from the absorber.

Thus, the optical sensor in the image forming apparatus may be a reflection-type sensor. In this case, the absorber is composed of a highly reflective member such as a white color member. As the absorber absorbs the discarded ink, the light reflectance of the absorber is reduced and, therefore, the output value of the optical sensor is lowered. Then, when the value becomes a predetermined value or less, it can be sensed that the height of the mountain top of the discarded ink in the discarded-ink tank reaches the predetermined height.

Alternatively, in the image forming apparatus as described above, the optical sensor senses light transmitted through the absorber.

Thus, the optical sensor may be a transmission-type sensor. In this case, the absorber is composed of a transmissive member such as a transparent member. As the absorber absorbs the discarded ink, the light transmittance of the absorber is reduced and, therefore, the output value of the optical sensor is lowered. Then, when the output value becomes a predetermined value, it can be sensed that the height of the mountain top of the discarded ink in the discarded-ink tank reaches the predetermined height.

Also, in the image forming apparatus as described above, preferably, the absorber is a rectangular parallelepiped and exposes only one face of the absorber to an inside of the discarded-ink tank which face has a smallest surface area.

Thus, in the image forming apparatus, only the face of the absorber which face has the smallest surface area may be exposed to the inside of the discarded-ink tank. As the surface area of the absorber which is exposed to the discarded-ink tank is made be small, the adhesion of ink spray falling in the discarded-ink tank or ink mist on the absorber can be reduced. Therefore, an error of sensing can be reduced which error indicates that the mountain top of the discarded ink has reached the predetermined height although the mountain top of the discarded ink in the discarded-ink tank has not reached the predetermined height, in which the error can be caused by the change of the color of the absorber and the decrease of the output of the optical sensor due to the adhesion of ink spray falling in the discarded-ink tank or ink mist on the absorber.

Also, in the image forming apparatus as described above, preferably, at least, a lower end portion of a side face of the absorber which side face faces the discarded ink accumulated in the mountain-like shape and an end portion of a bottom face of the absorber which end portion faces the discarded ink accumulated in the mountain-like shape are exposed to an inside of the discarded-ink tank.

Thus, in the image forming apparatus, a lower end portion of a side face of the absorber which side face faces the discarded ink accumulated in the mountain-like shape and an end portion of a bottom face of the absorber which end portion faces the discarded ink accumulated in the mountain-like shape are exposed to the inside of the discarded-ink tank. Accordingly, ink flowing along a slope near the mountain top of the discarded ink accumulated in the mountain-like shape can be absorbed well.

Also, in the image forming apparatus as described above, preferably, the sensing device includes a holding member configured to hold the absorber and the optical sensor with a certain distance therebetween and the holding member includes a cover part that covers a space between the absorber and the optical sensor.

Thus, in the image forming apparatus, a case such as the holding member configured to hold the absorber and the optical sensor with a certain distance therebetween is provided and the case covers the space between the absorber and the optical sensor. Accordingly, incoming light other than the light to be sensed in the space can be reduced. As a result, the optical sensor can sense the light from or through the absorber more accurately. Also, the ink mist coming into the space between the absorber and the optical sensor can be reduced by covering the space with the cover part. Accordingly, the contamination of a sensing face of the optical sensor with the ink mist can be reduced and the sensing error of the optical sensor can be reduced.

In the image forming apparatus as described above, preferably, the ink is a water-based ink including a pigment and a solvent in which at least one of a wetting agent (humectant) and a penetrating agent, etc., is contained in water and a viscosity of the ink at 25° C. is equal to or greater than 5 mPa·sec.

Thus, in the image forming apparatus, a water-based ink including a pigment and a solvent in which at least one of a wetting agent (humectant) and a penetrating agent, etc., is contained in water and having an ink viscosity equal to or greater than 5 mPa·sec at 25° C. is used. Accordingly, printing can be made on a normal paper with satisfactory properties of an image such as a color reproduction property, a fastness property, a light fastness property, an ink drying property, character bleeding, color border bleeding, and a double face printing property.

Further, an example of the image forming apparatus according to the present invention is described below.

First, the basic structure of the image forming apparatus is described. FIG. 1 is a front view showing the general structure of an image forming apparatus according to the embodiment of the present invention.

The image forming apparatus 1 includes a image forming unit 2 for forming an image which includes a carriage 9 and a paper feeding cassette 50 for stacking and holding a number of papers P which is detachable from the front side of the apparatus body 1 (the front side in FIG. 1). Also, an image reading part 60 for reading an original copy is arranged at the upper side of the apparatus body 1.

Also, a cartridge installing part 35 that holds ink cartridges 34Y, 34M, 34C, 34Bk-1, and 34Bk-2 is included in the apparatus body. Also, each color ink cartridge 34 is detachably installed in the cartridge installing part 35.

In the image reading part 60, the first traveler 66 composed of a light source 64 for illuminating an original copy and a mirror 65 and the second traveler 69 composed of two mirrors 67 and 68 are arranged to be able to move in a reciprocating manner, in order to scan and read an original copy (not shown in the figure) put on a contact glass 61. Image information scanned by the reading travelers 66 and 69 is read as an image signal by an image reading element 63 such as a CCD provided behind a lens 62. The read image signal is digitized and image-processed. An image is formed on a paper P by the image forming unit 2 based on the image-processed signal.

Also, the image forming apparatus 1 can receive data of the image formed on the image forming unit 2 through a telecommunications cable or network from an external instrument and process the received image data to form an image. As an external instrument for inputting data of an image formed on the image forming unit 2, for example, an information processing apparatus such as a personal computer, an image reading apparatus such as an image scanner and an imaging apparatus such as a digital camera can be provided.

Figure 2:
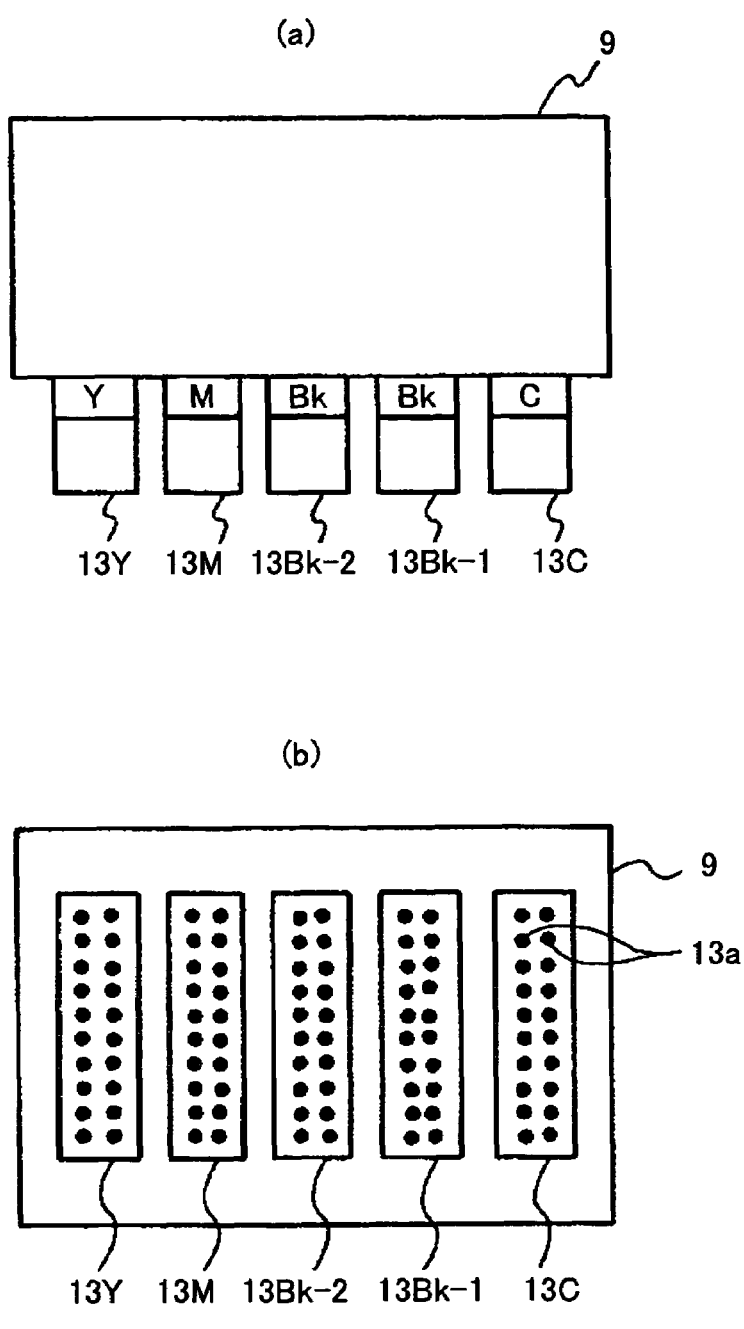
FIG. 2A is a front view of a carriage and FIG. 2B is a bottom view of the carriage.

FIG. 2A is a front view of the carriage 9 and FIG. 2B is a bottom view of the carriage 9. As shown in FIG. 2A, the carriage 9 is provided with five heads 13C, 13Bk-1, 13Bk-2, 13M, and 13Y (the color representations C, Bk-1, Bk-2, M, and Y are appropriately omitted below). As shown in FIG. 2B, each head 13 is provided with two columns of ejection ports 13*a* (192 ejection ports per one column).

Figure 3:
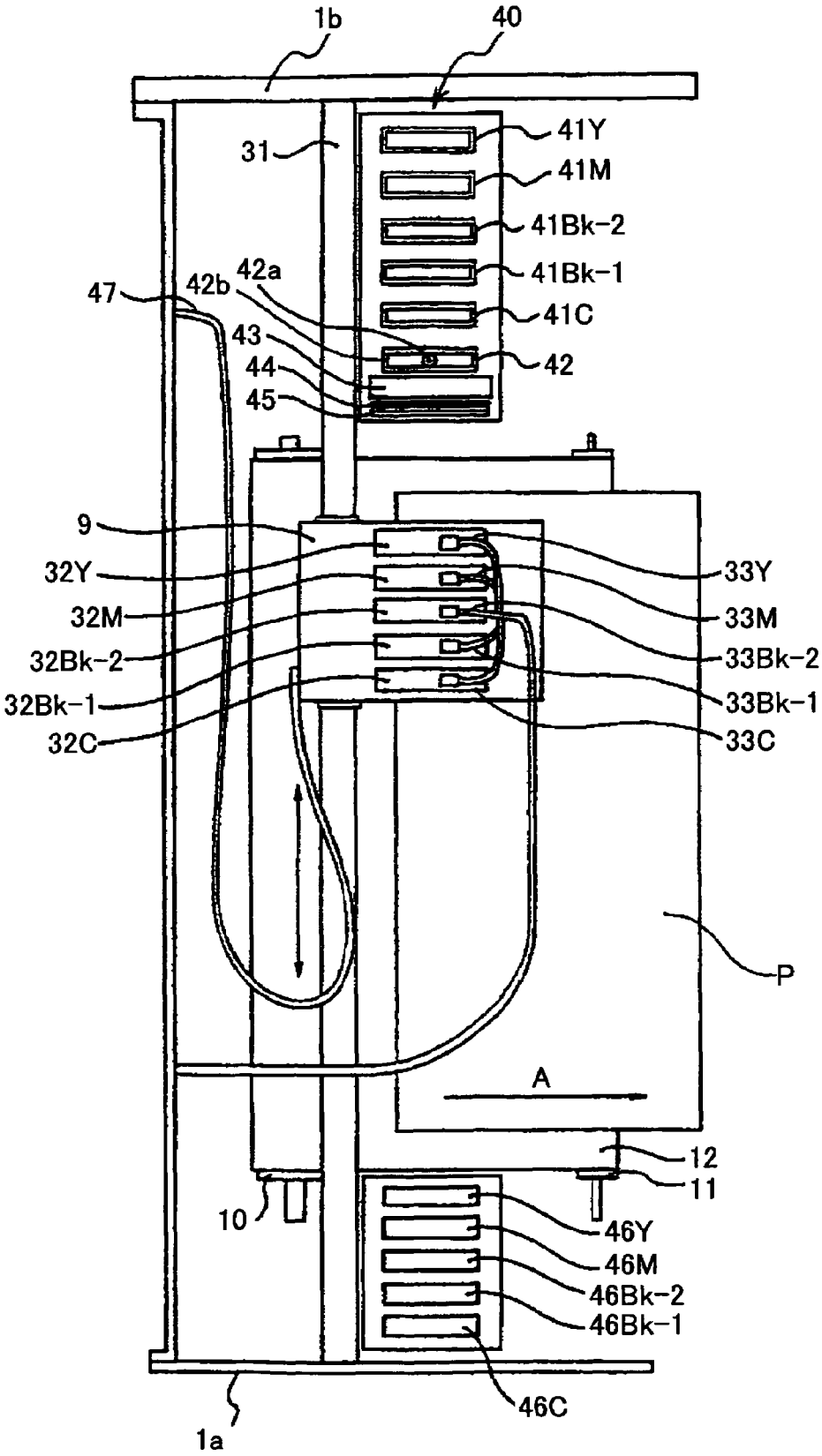
FIG. 3 is a plan view showing the general structure of an image forming unit.

FIG. 3 is a plan view showing the general structure of the image forming unit 2. As shown in FIG. 3, a guide rod 31 for supporting the carriage 9 penetrates through the carriage 9 and is bridged between a side face 1*a* at the front side of the body and a side face 1*b* at the back side thereof. Also, the image forming unit 2 has a carriage supporting member spacing out from and extending parallel to the guide rod 31, which member is not shown in the figure, and the carriage 9 is supported to be able to translate along the main scanning directions by the guide rod 31 and the carriage supporting member. The carriage 9 is provided with sub-tanks 32C, 32Bk-1, 32Bk-2, 32M, and 32Y (the color representations C, Bk-1, Bk-2, M, and Y are appropriately omitted below) for feeding respective color ink liquids to respective heads 13C, 13Bk-1, 13Bk-2, 13M, and 13Y. One end of a feeding tube 33C, 33Bk-1, 33Bk-2, 33M or 33Y (the color representations C, Bk-1, Bk-2, M, and Y are appropriately omitted below) corresponding to each color is connected to each sub-tanks 32. The other end of the ink drop feeding tube 33 is connected to a feeding pump of the cartridge installing part 35 for containing respective color ink cartridges 34C, 34Bk-1, 34Bk-2, 34M, and 34Y (the color representations C, Bk-1, Bk-2, M, and Y are appropriately omitted below), shown in FIG. 1, which pump is not shown in the figure. Then, the ink liquid in the ink cartridge 34 is fed into the sub-tank 32 through the feeding tube 33 by appropriately driving the feeding pump. Also, a harness 47 connecting to a control part of the printer which part is not shown in the figure is attached to the carriage 9.

At the back side (the upper side in the figure) of the image forming unit 2, a restoration and maintenance device 40 with moisture retention caps 41C, 41Bk-1, 41Bk-2, 41M, and 41Y (the color representations C, Bk-1, Bk-2, M, and Y are appropriately omitted below) corresponding to the respective color heads 13 and an aspiration cap 42 are provided. Also, the restoration and maintenance device 40 has the first blank ejection receiver 43, a wiper blade 44, and a control roller 45. The moisture retention cap 41 caps the ejection port 13*a* of each head 13 at the time of no image formation and keeps the ejection port 13*a* in a wetted condition. Also, the moisture retention cap 41 is perforated so as to have a micro-communicating hole that communicates with the atmosphere and is not shown in the figure whereby the pressure in a moisture retention room is always kept at the atmospheric pressure and the meniscus of ink at the ejection port 13*a* is kept constant. The aspiration cap 42 provided at the front side (the lower side in FIG. 3) of the moisture retention cap 41 is provided with an aspiration hole 42*a* and an aspirator 42*b* is attached to the aspiration hole 42*a*. The aspiration cap 42 aspirates an air bubbles or dust adhering to the ejection port 13*a* together with ink by the aspirator 42*b* of the aspiration cap 42 and, therefore, has a function of reducing ejection failure. The first blank ejection receiver 43 is provided in order to keep a stable ejection performance, for example, by performing the blank ejection before the start of recording and adjusting the meniscus of ink at the ejection port 13*a*. The wiper blade 44 is provided in order to clean ink liquid adhering to a face having the ejection port 13*a* of the head 13. The control roller 45 is provided in order to press the wiper blade 44 on the aperture portion of the first blank ejection receiver 43 and to scratch off the dirt of the wiper blade 44 and bring it into the aperture portion of the first blank ejection receiver 43. Each of the moisture retention cap 41, the aspiration cap 42, the wiper blade 44, and the control roller 45 can move up and down by means of a cam shaft.

At the front side (the lower side in FIG. 3) of the image forming unit 2, the second blank ejection receivers 46C, 46Bk-1, 46Bk-2, 46M, and 46Y corresponding to the respective heads 13 are provided. The second blank ejection receivers are provided in order to keep the same viscosity of a color ink that has not been used for image formation during the image formation as the viscosity of the used color ink. Specifically, the same viscosity of a color ink that has not been used for image formation during the image formation as the viscosity of the used color ink can be kept by ejection of the unused color ink to the second blank ejection receiver 46.

Next, the operation of image formation in the image forming apparatus 1 according to the embodiment of the present invention is described below.

First, an original copy is set on the contact glass 61 of the image reading part 60 and a start switch is pushed which is not shown in the figure. Then, the first traveler 66 and the second traveler 69 travel so that the first traveler 66 emits light from the light source 64 thereof, reflects light reflected from the surface of the original copy and directs the light to the second traveler 69. The light reflected from the surface of the original copy and directed to the second traveler 69 is reflected by the mirrors 67 and 68 of the second traveler 69 and enters the image reading element 63 through the lens 62, in which the contents of the original copy are read and image data are produced. Alternatively, image data as image information are sent through a telecommunications cable, etc., from an external instrument such as a personal computer that is not shown in the figure.

Next, papers P are fed from the paper feeding cassette 50 and conveyed while the papers are separated piece by piece by a separation roller 52 and a friction pad 51. The conveyed paper P is further conveyed to the image forming unit 2 by a feeding roller pair 53. The paper P conveyed to the image forming unit 2 is pressed on the conveyer belt 12 by means of a pressurizing control roller 13. The surface of the conveyer belt 12 is charged by a charging roller 14 and the paper P electrostatically adheres to the surface. The electrostatically adhering paper P is conveyed at a position facing the carriage 9 by the conveyer belt 12. When the paper P reaches the position facing the carriage 9, the movement of the conveyer belt 12 is stopped.

Before the input of an image signal, the carriage 9 is positioned above the restoration and maintenance device 40 shown in FIG. 3 (the position is referred to as a "home position 2, below). Also, before the input of an image signal, the carriage 9 is positioned at the home position and both the head 13 and the moisture retention cap 41 contact each other and keep the ejection port 13*a* in a wetted condition. As an image signal is input, the moisture retention cap 41 is lowered and the carriage 9 starts to move along the main scanning directions. Then, whenever the head 13 corresponding to each color is positioned at the first blank ejection receiver 43, the movement of the carriage 9 is stopped and several drops of ink are ejected toward the first blank ejection receiver 43. After blank ejections for all color heads 13 are completed, the carriage 9 starts to move again along the main scanning directions. Then, while the carriage 9 moves above a paper P along the main scanning directions in accordance with image signals, predetermined ink liquid is ejected on a predetermined location on the stopped paper P, thereby forming one line of an image on the paper P. Herein, the term one line" referrers to a recordable range of a paper along the sub-scanning line directions using the head 13. After one line of image is formed, if necessary, the carriage 9 is moved to the position of the second blank ejection receiver 46 and several drops of unused color ink are blank-ejected to the second blank ejection receiver 46. Then, after the recording of one line on the paper P along the main scanning directions is completed, the conveyer belt 12 is driven for a certain period of time and the paper P is moved by one line toward the direction of paper ejection and stopped. After the movement of the conveyer belt 12 is stopped, the carriage 9 moves above the paper P along the main scanning directions in accordance with an image signal and the next one line of image is formed, as described above. Such a process is repeated by the predetermined number of times whereby a desired image is printed on the paper P. Since the paper P electrostatically adheres to the conveyer belt 12 while an image is being formed on the paper by repeating the conveyance and stop of the paper, the paper can be stably conveyed to a position facing the head 13. Also, since the paper is pressed on the conveyer belt 12 by the pressurizing control roller 13, the paper can reliably electrostatically adhere to the conveyer belt 12. The paper on which the desired image is formed is conveyed to a paper ejection tray 7 by paper ejection pairs 74, 75, 76 and 77, each of which are composed of a paper ejection roller and a spur.

Figure 4:
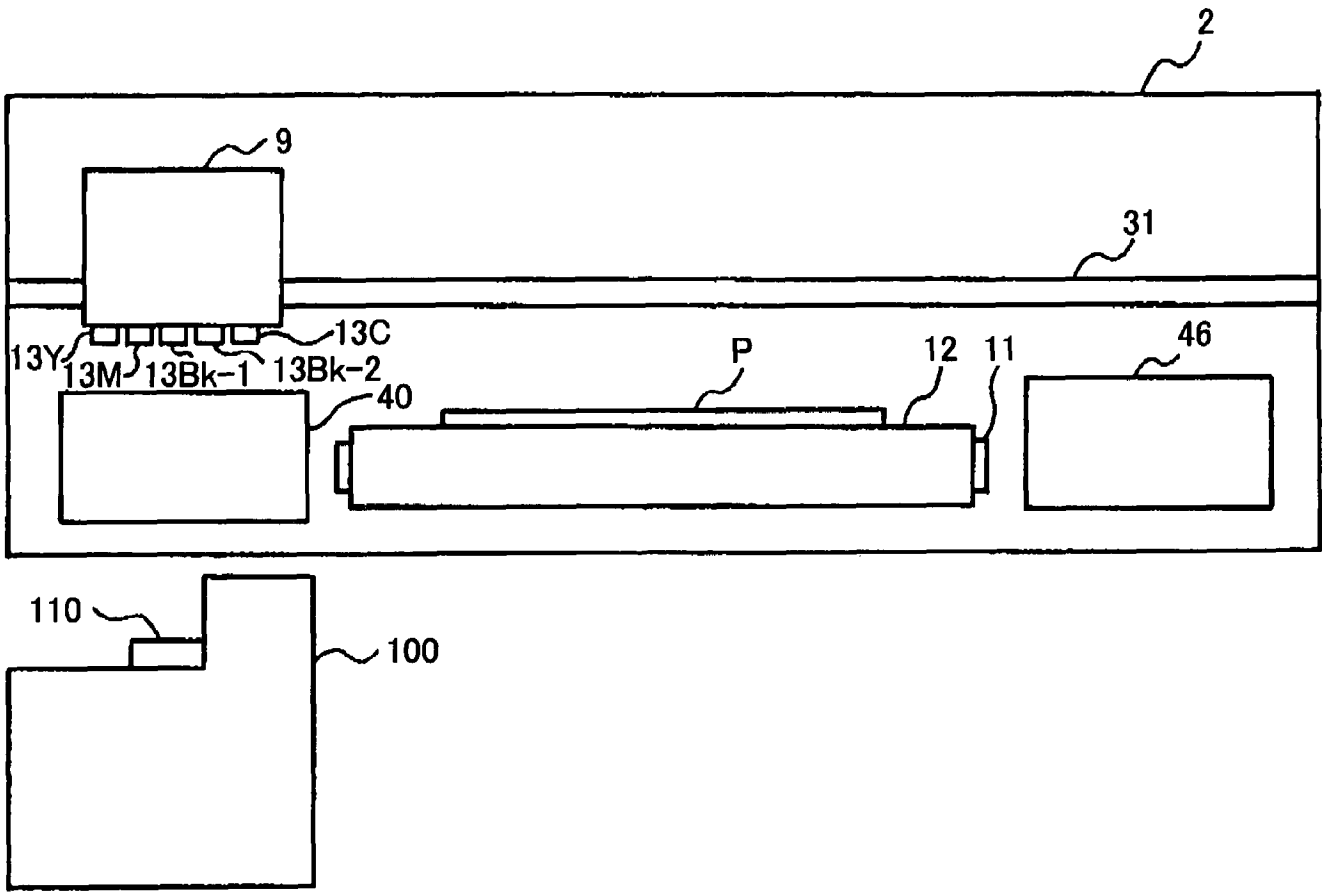
FIG. 4 is a diagram showing the positional relationship between the image forming unit and a discarded-ink tank.

FIG. 4 is a diagram showing the positional relationship between the image forming unit 2 and a discarded-ink tank 100. Ink aspirated by the aspiration cap 42, ink ejected onto the first blank ejection receiver 43, and ink adhering to the wiper blade 44 are collected in the discarded-ink tank arranged at the lower side of the maintenance and restoration device 40.

Figure 5:
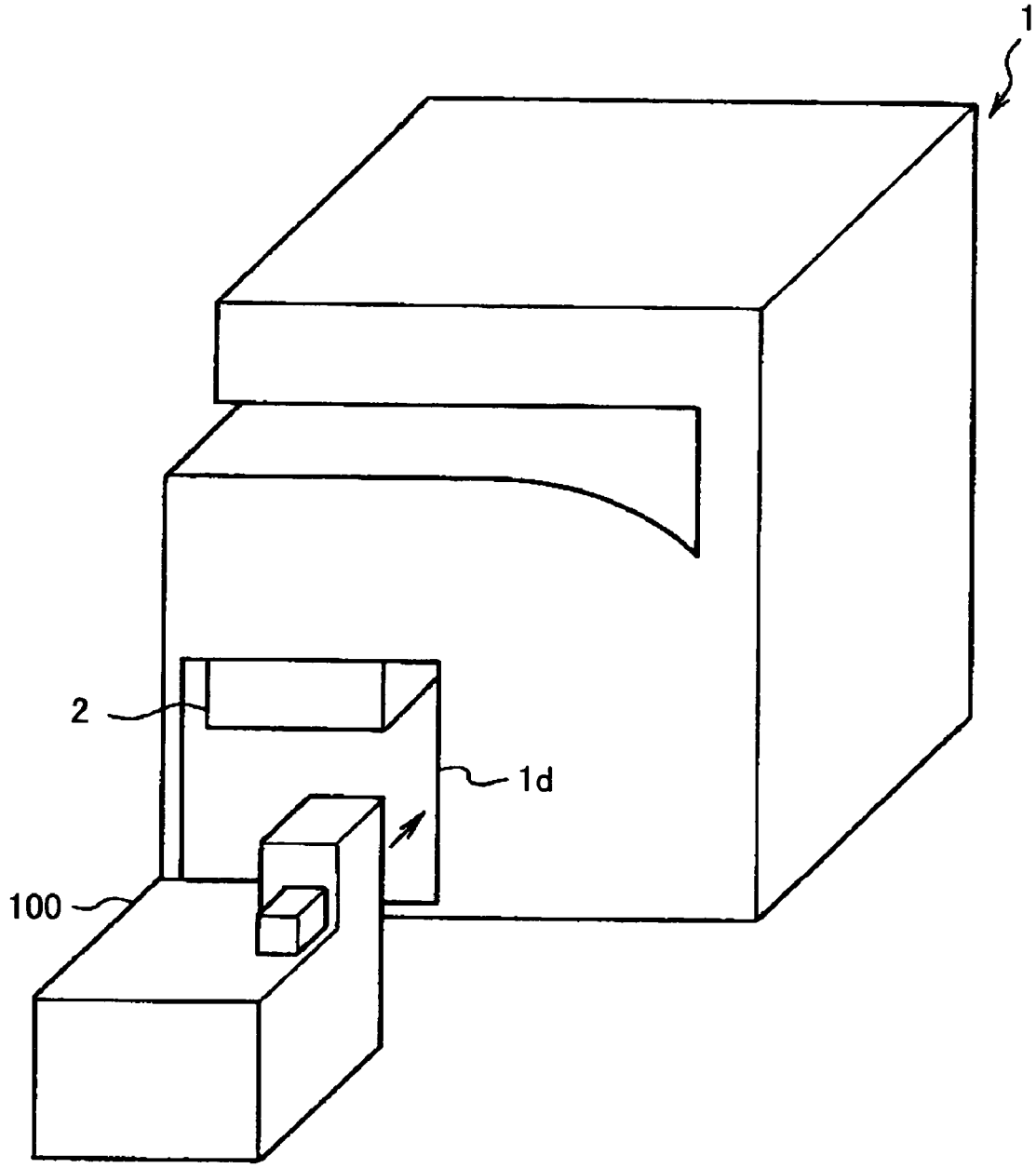
FIG. 5 is a perspective diagram showing a condition of inserting the discarded-ink tank into the image forming apparatus.

The discarded-in tank 100 is attachable and detachable to the apparatus body through an aperture portion 1*d* provided at the back side of the image forming apparatus as shown in FIG. 5.

Also, as shown in FIG. 4, the discarded-ink tank 100 is provided with a sensing device 110 for sensing discarded ink in the discarded-ink tank.

Figure 6:
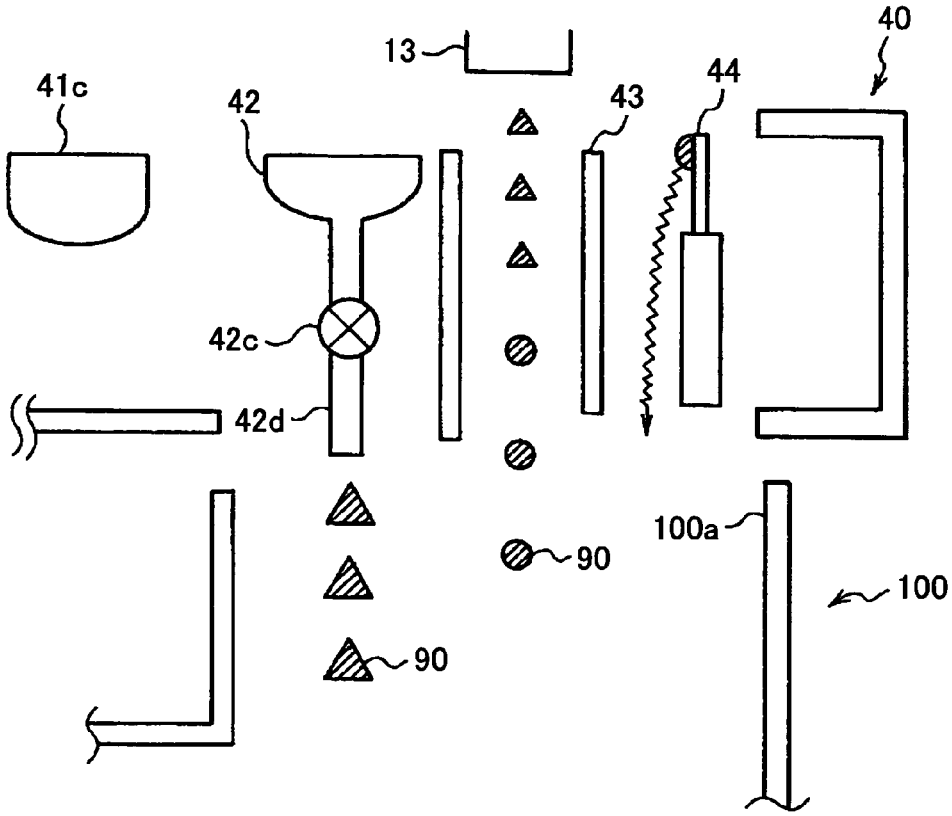
FIG. 6 is a diagram showing an essential part of the discarded-ink tank and maintenance and restoration device.

FIG. 6 is a schematic diagram showing an essential part of the discarded-ink tank 100 and maintenance and restoration device 40. As shown in FIG. 6, when the discarded-ink tank 100 is installed in the apparatus body, an aperture portion 100*a* of the discarded-ink tank 100 faces the aspiration cap 42, the first blank ejection receiver 43, and the wiper blade 44. Then, ink aspirated by an aspirator 42*c* of the aspiration cap 42 is dropped to the aperture portion 100*a* of the discarded-ink tank through a tube 42*d* and collected in the discarded-ink tank 100. Also, no bottom face is formed for the first blank ejection receiver 43 and ink ejected from the head 13 passes through the first blank ejection receiver 43, directly drops to the aperture portion 100*a* of the discarded-ink tank, and is collected in the discarded-ink tank 100. Also, ink adhering to the wiper blade 44 as a result of cleaning of the head 13 directly drips downward, is dropped to the aperture portion 100*a* of the discarded-ink tank, and is collected in the discarded-ink tank 100.

Figure 7:
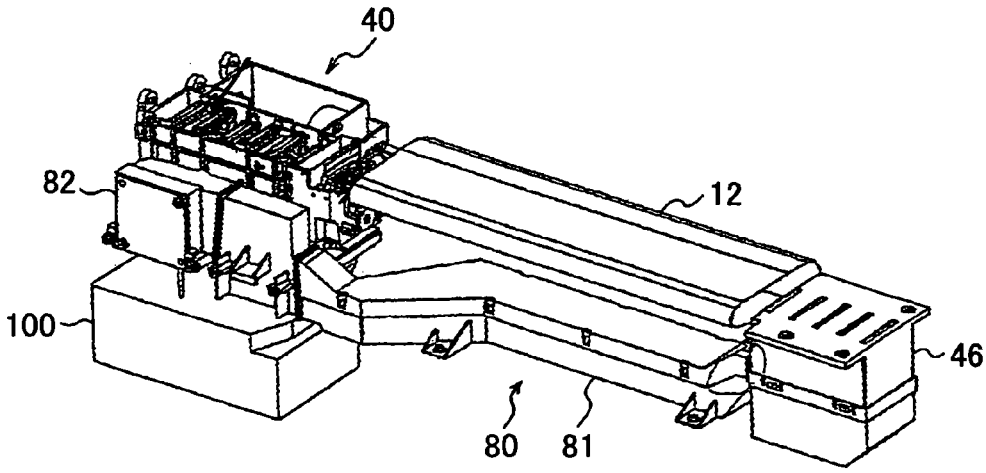
FIG. 7 is a perspective view showing a recovery mechanism for recovering ink mist in the second blank ejection receiver.

Next, a mechanism of recovering ink dropped onto the second blank ejection receiver 46 in the discarded-ink tank is described below. FIG. 7 is a perspective view showing a recovery mechanism 80 for recovering ink mist in the second blank ejection receiver 46. As shown in FIG. 7, the image forming apparatus 2 includes the recovery mechanism 80 for recovering the ink mist in the second blank ejection receiver 46. One aperture portion of the recovery mechanism 80 is joined to the second blank ejection receiver 46 and the other aperture includes a recovery duct 81 arranged at the side of the discarded-ink tank. Also, the recovery mechanism 80 includes a fan 82 at the discarded-ink tank 100 and an air stream that flows from the second blank ejection receiver 46 to the side of the discarded-ink tank is generated in the recovery duct 81 by the fan 82.

Figure 8:
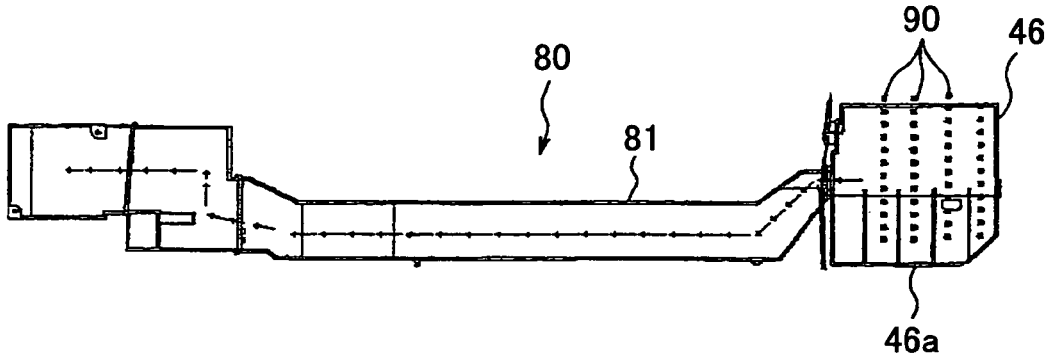
FIG. 8 is a schematic diagram of the recovery mechanism.

FIG. 8 is a schematic diagram of the recovery mechanism 80. As shown in FIG. 8, ink ejected into the second blank ejection receiver 46 is collected in an ink receiving part 46*a* provided on the bottom face of the second blank ejection receiver 46. The second blank ejection receiver 46 is configured to be able to be exchanged and exchanged appropriately when the ink receiving part 46*a* is filled with discarded ink. Also, ink mist in the second blank ejection receiver 46 flows into the inside of the recovery duct 81 due to the air stream from the second blank ejection receiver 46 to the side of the discarded-ink tank which is generated by the fan 82. The ink mist flowing into the recovery duct 81 moves to the side of the discarded-ink tank 100 due to the air stream in the recovery duct. The ink mist flowing into the side of the discarded-ink tank 100 is recovered by a filter arranged at the discarded-ink tank.

Figure 9:
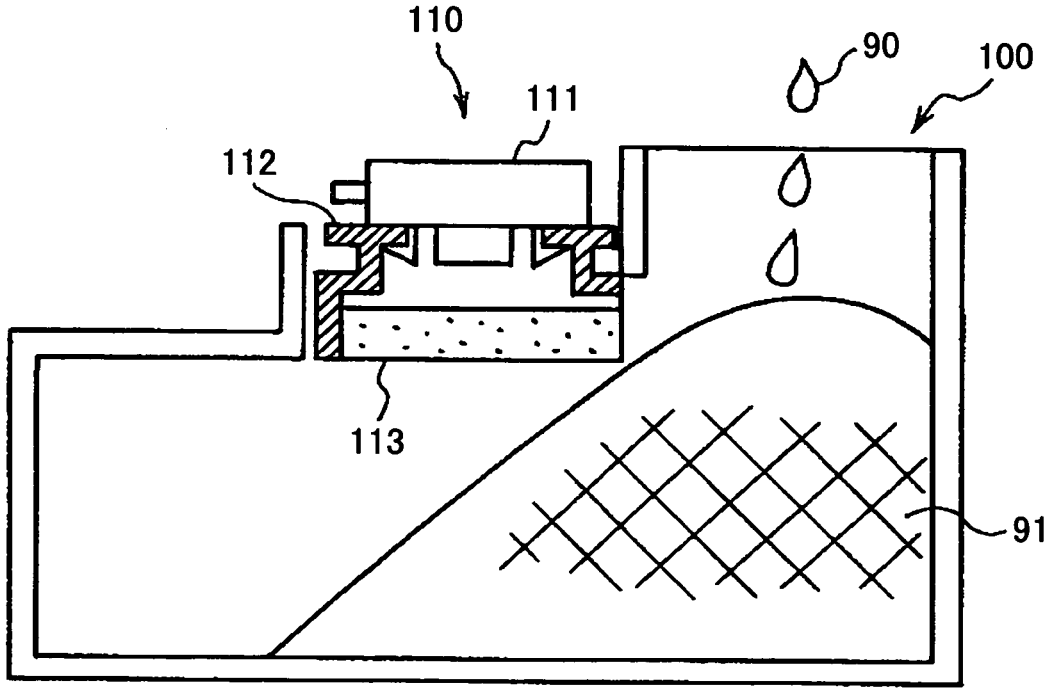
FIG. 9 is a schematic diagram of the discarded-ink tank.
Figure 10:
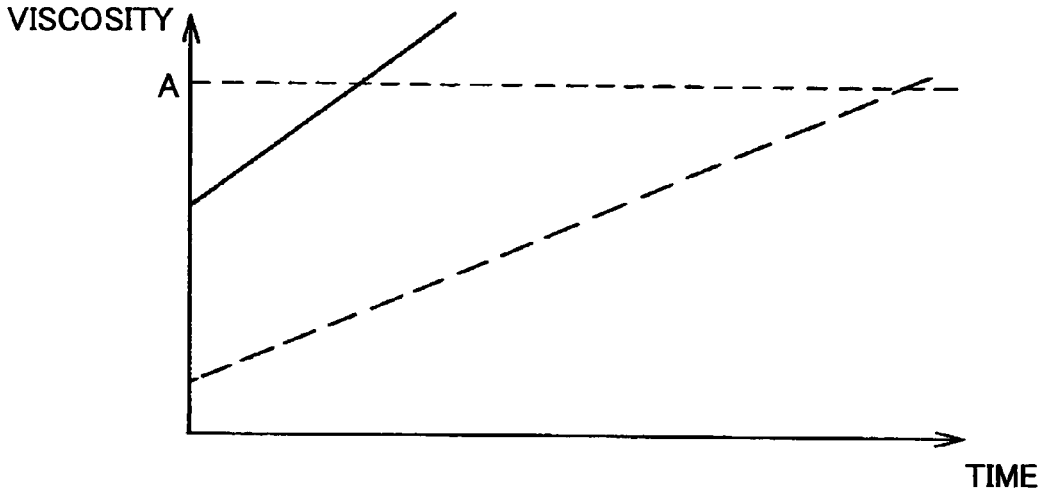
FIG. 10 is a graph for comparing time periods for reaching the viscosities at which ink used in the embodiment of the present invention and another ink loose fluidity thereof.

FIG. 9 is a schematic diagram of the discarded-ink tank 100. In the image forming apparatus according to the embodiment of the present invention, a water-based ink that contains a pigment and a solvent having a high viscosity and a quick-drying property is used as described below. Therefore, as shown in FIG. 10, a time period required for reaching a viscosity A showing loss of fluidity with respect to ink used in the embodiment of the present invention which is illustrated by a solid line in the figure is extremely short compared to a commonly used ink as illustrated by a dotted line in the figure. Therefore, the discarded ink is collected in the discarded-ink tank on the condition that the fluidity of the ink is lost. Normally, discarded ink dropped into the discarded-ink tank has not reached a viscosity at which the fluidity is lost, adheres to the discarded ink in the discarded-ink tank and then equivalently extends. However, under a high temperature environment or low humidity environment, since the evaporation of an evaporating component in the ink is accelerated, the ink may reach a viscosity at which the fluidity is lost at the stage of dropping the ink into the discarded-ink tank. When such an ink having lost the fluidity thereof adheres to the discarded ink in the discarded ink tank, the ink does not equivalently extend and adhere as agglomerate. Also, ink that is not ejected to the discarded ink tank by the aspirator 42*c* of the aspiration cap 42 and adheres to the inside of the aspiration cap 42 or tube 42*d* is ejected into the discarded-ink tank at the time of next aspiration. The ink adhering to the inside of the aspiration cap 42 or tube 42*d* may grow to an ink with a viscosity at which the fluidity is lost by the evaporation of an evaporating component in the ink while adhering to the inside of the aspiration cap 42 or tube 42*d*. The discarded-ink adhering to the aspiration cap 42 or tube 42*d* and having lost the fluidity thereof does not equivalently extend and adheres as agglomerate when adhering to the discarded ink in the discarded-ink tank. As a result of depositing the discarded ink that adheres as agglomerate, the discarded ink 91 in the discarded ink tank will have a shape of building up near the aperture portion of the discarded-ink tank as shown in FIG. 9.

A sensing device 110 for sensing whether a predetermined amount of discarded ink 91 is collected in the discarded-ink tank, which is shown in FIG. 9, senses whether a predetermined amount of the discarded ink 91 is collected in the discarded-ink tank by discarded ink flowing down from the discarded ink 91 having a shape of building up near the aperture portion of the discarded-ink tank.

Figure 11:
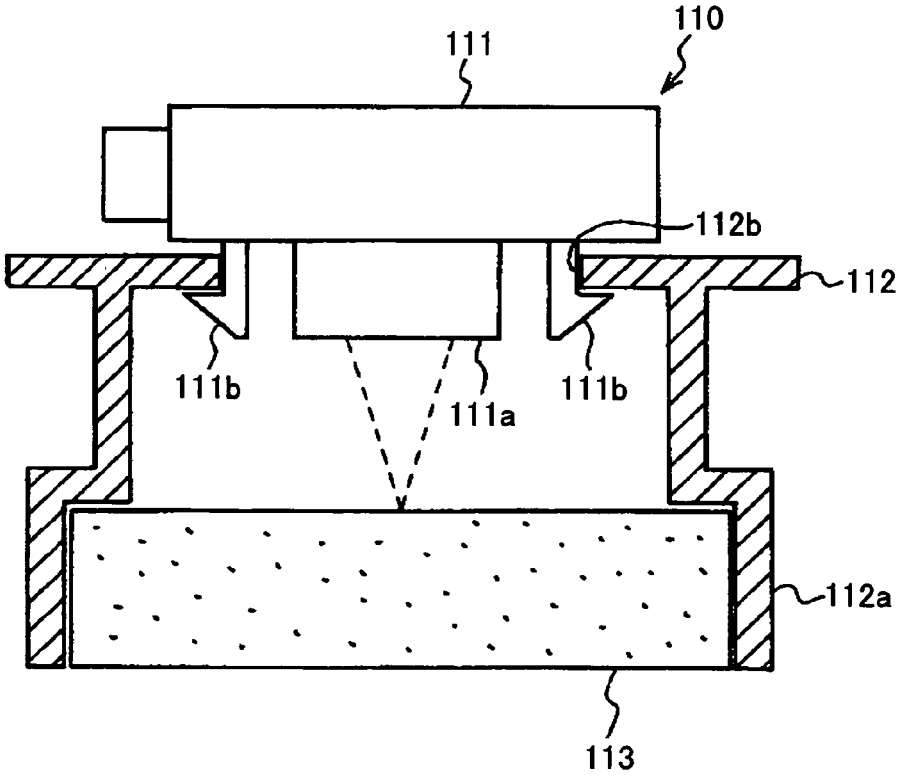
FIG. 11 is a cross-sectional view of a sensing device for sensing whether a predetermined amount of discarded ink is collected in the discarded-ink tank.

FIG. 11 is a cross-sectional view of an essential part of the sensing device 110. As shown in FIG. 11, the sensing device 110 includes a reflection-type optical sensor 111, an absorber 113 for absorbing ink liquid, and a case 112 for holding the optical sensor 111 and the absorber 113. The absorber 113 is made of a material that easily absorbs ink liquid, such as felt and sponge, and has a color that can reflect light well, such as white. The optical sensor 111 is attached to the case 112 so that it has a predetermined space from the absorber 113. The case 112 covers a space between the absorber 113 and the optical sensor 111 whereby light does not enter the space or ink mist does not flow into the space. The sensing error of the optical sensor 111 which is caused by the adhesion of ink mist onto a sensing surface 111*a* of the optical sensor 111 can be prevented by covering the space between the absorber 113 and the optical sensor 111 with the case. Also, only light reflected from the absorber 113 can be sensed by the optical sensor 111 and whether ink is absorbed by the absorber 113 can be sensed well, since the case covers the space.

Figure 12:
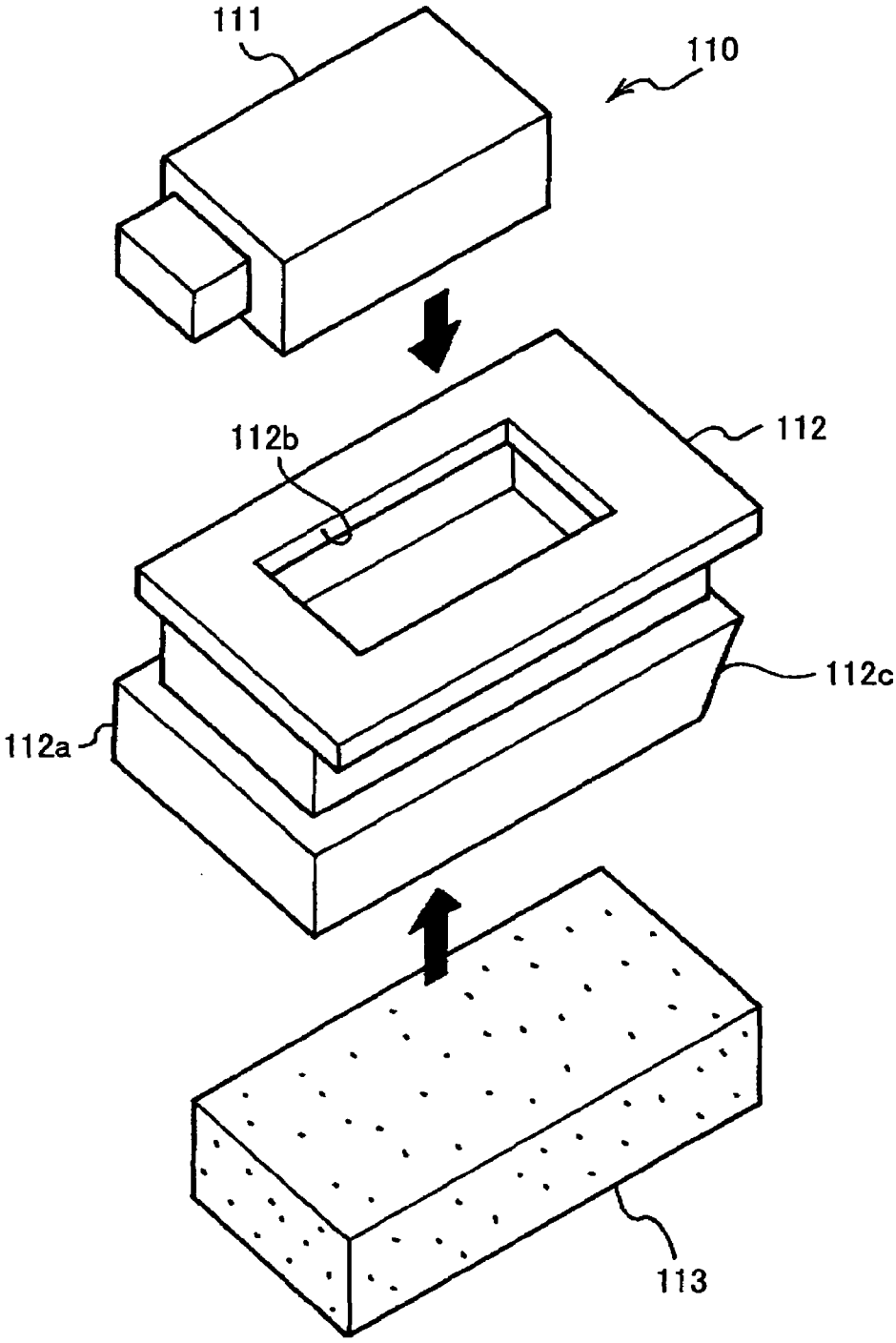
FIG. 12 is an exploded perspective view of the sensing device.

FIG. 12 is an exploded perspective view of the sensing device 110. As shown in FIG. 12, the optical sensor 111 is inserted into and attached to the upper aperture portion 112*b* of the case 112. The optical sensor 111 includes a claw-shaped part 111*b* as shown in FIG. 11, and the claw-shaped part 111*b* engages the upper aperture portion 112*b* of the case whereby the optical sensor 111 is attached to the case 112.

Figure 13:
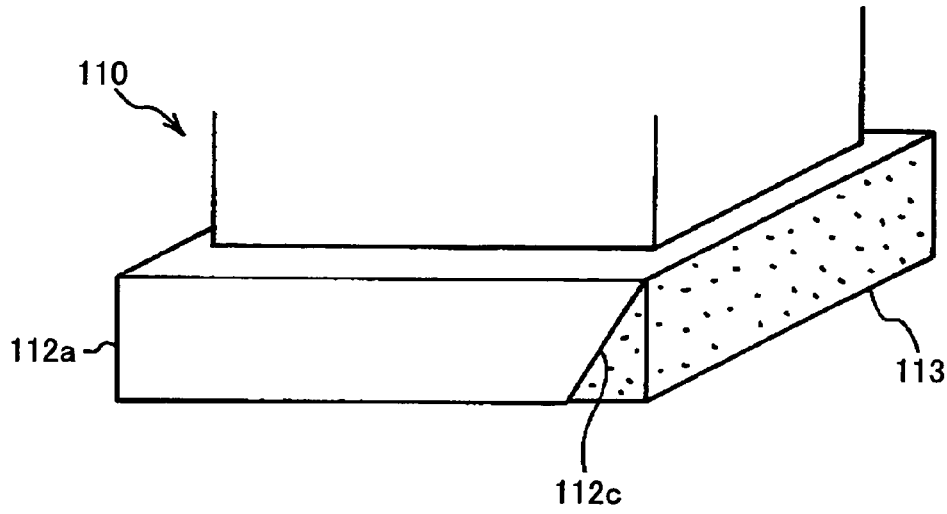
FIG. 13 is a perspective view of an essential part of the sensing device.

The absorber 113 is fixed on an absorber holding part 112*a* of the case 112 using an adhesive. As shown in FIG. 12, the absorber holding part 112*a* of the case is provided with a notch 112*c*. As shown in FIG. 13, where the absorber 113 is attached, a portion of the absorber 113 is exposed. The absorber is attached so that the exposed portion is directed to the side of the aperture portion of the discarded-ink tank shown in FIG. 9, whereby ink flowing along a slope of the discarded ink accumulated in a mountain-like shape can be received by the exposed portion of the absorber 113.

Next, the sensing of discarded ink in the discarded-ink tank by the sensing device 110 is described using FIG. 9. When newly discarded ink adheres to the ink deposited in the discarded-ink tank so that the ink builds up near the aperture portion of the discarded-ink tank shown in FIG. 9, discarded ink that has not lost the fluidity thereof yet at the stage of adhesion flows along a slope of the discarded ink deposited as a mountain-like shape near the aperture portion of the discarded-ink tank. When the mountain top of the discarded ink in the discarded-ink tank reaches near the aperture portion of the discarded-ink tank, the exposed portion of the absorber 113 of the sensing device 110 approaches the slope of the mountain. Then, discarded ink flowing along the slope of the discarded ink deposited as a mountain-like shape adheres to the exposed portion of the absorber of the sensing device 110. The discarded ink adhering to the exposed portion is absorbed due to the capillarity of the absorber 113. Thus, when the absorber 113 absorbs ink flowing along the slope of the discarded ink deposited as a mountain-like shape several times, the color of the absorber 113 gradually changes from white to black. Then, the amount of light reflected from the absorber 113 is reduced and the output voltage of the optical sensor is reduced accordingly. Further, when the output voltage of the optical sensor 111 is equal to or less than a predetermined threshold value, a determination is made such that the mountain top of the discarded ink in the discarded-ink tank is near the aperture portion 100*a* of the discarded-ink tank, and an alert such that the discarded-ink tank should be exchanged is displayed on a display part of the image forming apparatus which part is not shown in the figure.

Figure 14:
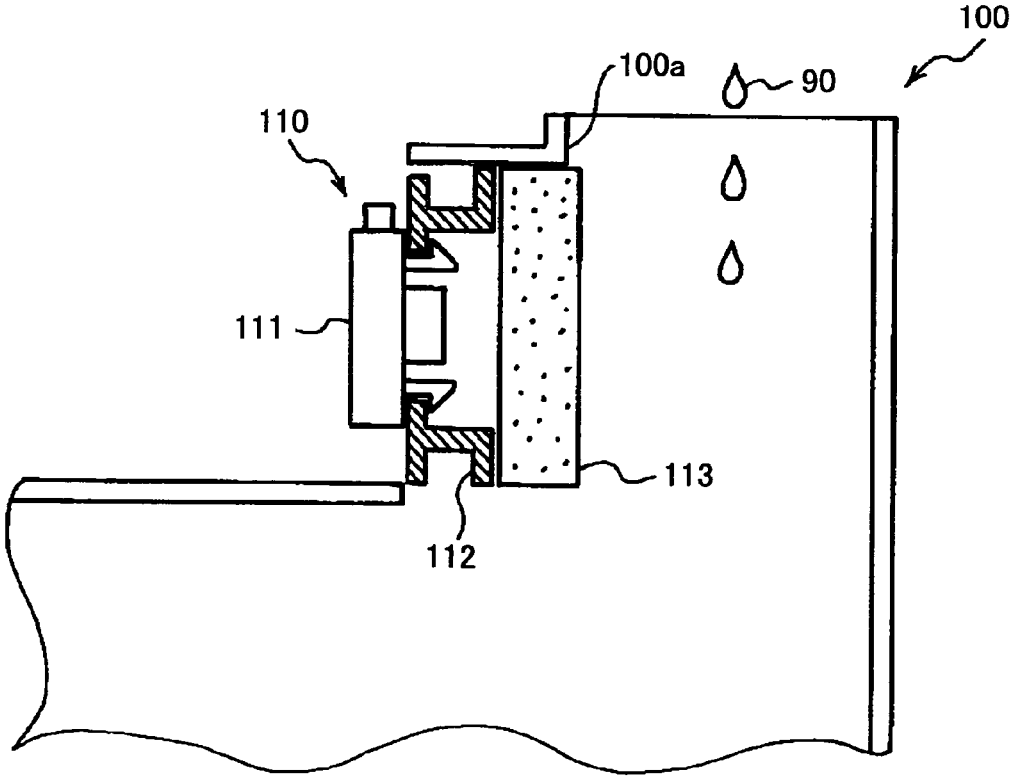
FIG. 14 is a diagram showing another example of the arrangement of the sensing device.

Also, although the absorber 113 is arranged so that the side face of the absorber is exposed to the aperture portion 100*a* of the discarded-ink tank in the above, the absorber 113 may be arranged so that the bottom face of the absorber is exposed to the aperture portion 100*a* of the discarded-ink tank as shown in FIG. 14. In this case, since the exposed surface area of the absorber 113 relative to that of the aperture portion 100*a* of the discarded-ink tank is large, ink mist or ink spray easily adheres to the absorber 113. A sensing error of the sensing device 110 may be made such that the mountain top of the discarded ink in the discarded-ink tank is indicated to be near the aperture portion 100*a* of the discarded-ink tank although the mountain top of the discarded ink in the discarded-ink tank has not been near the aperture portion of the discarded-ink tank yet, which error can be caused by the change of the color of the absorber 113 to black due to the adhesion of such ink mist or ink spray to the absorber 113.

Figure 15:
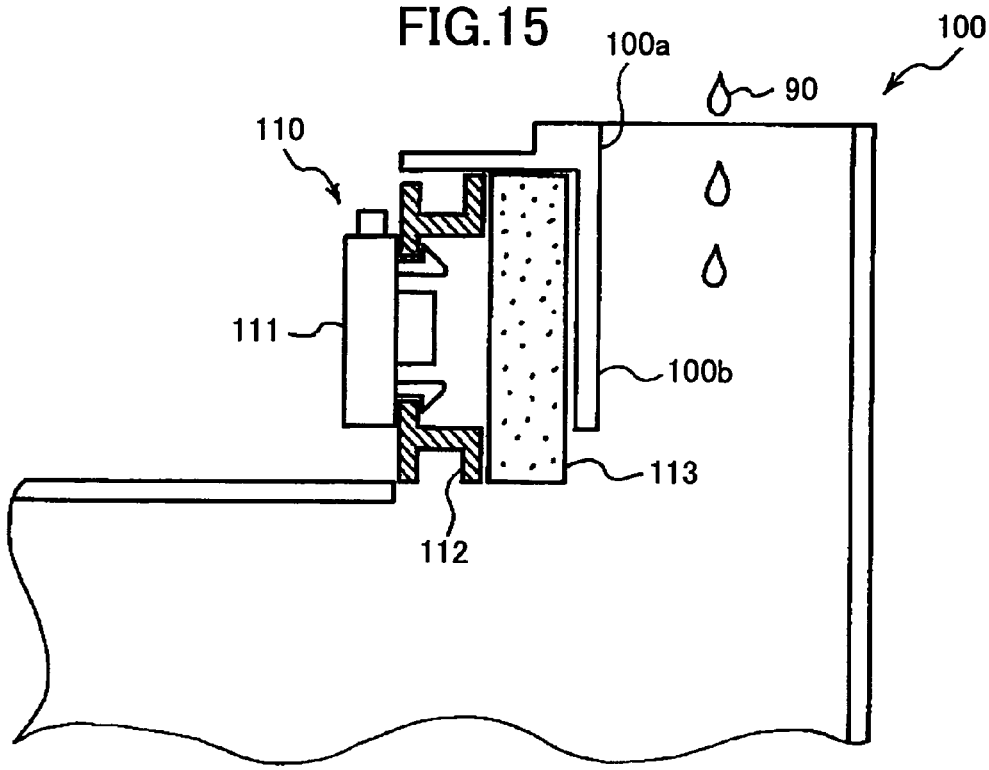
FIG. 15 is a diagram showing an example in which a covering part for covering a part of an absorber of the sensing device is provided in the discarded-ink tank.

Therefore, a shielding part 100*b* may be provided near the aperture portion 100*a* of the discarded-ink tank as shown in FIG. 15, so that only a part of the absorber 113 is exposed to the aperture portion 100*a* of the discarded-ink tank.

Figure 16:
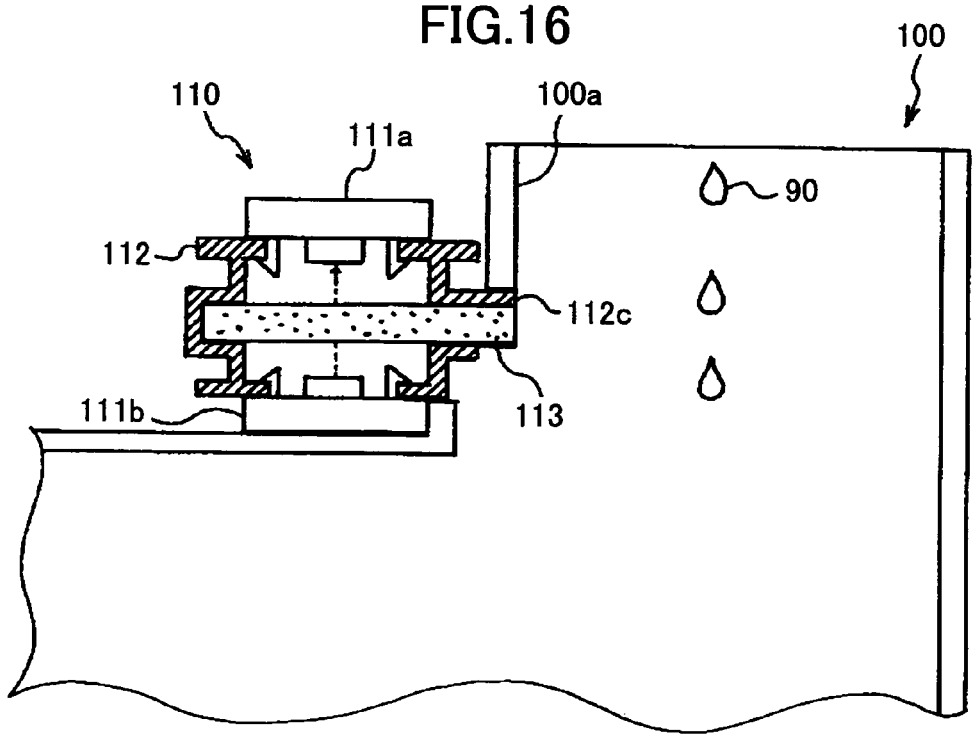
FIG. 16 is a diagram showing another example of the structure of the sensing device.

Also, the optical sensor 111 of the sensing device 110 is not limited to a reflection-type but may be a transmission-type one as shown in FIG. 16. When the optical sensor 111 is a transmission type as shown in FIG. 16, a light-emitting element 111*b* is attached to one aperture portion of the case 112 and a light-receiving element 111*a* is attached to the other aperture portion of the case 112. Then, an absorber 113 is held between the light-receiving element 111*a* and the light-emitting element 111*b*. At the side of the aperture portion of the discarded-ink tank of the case 112, a notch portion 112*c* is provided so as to expose a portion of the absorber 113. The absorber 113 is composed of a member that easily transmits light, such as a transparent member. When the optical sensor 111 is a transmission type, discarded ink flowing along a slope of the discarded ink having a mountain-like shape in the discarded-ink tank is also absorbed by the exposed portion of the absorber 113 similar to the case of the reflection type. Then, the color of the absorber 113 gradually changes from transparent to black so that light from the light-emitting element 111 is blocked by the absorber 113 and does not reach the light-receiving element 111*a*. Further, the output of the optical sensor 111 is lowered. Then, when it is equal to or less than a predetermined threshold value, a determination is made such that the mountain top of the discarded ink in the discarded-ink tank is near the aperture portion of the discarded ink tank, and an alert such that the discarded-ink tank should be exchanged is displayed on a display part of the image forming apparatus which part is not shown in the figure.

Thus, in the embodiment of the present invention, an absorber is arranged at a location at which ink falls in a discarded-ink tank and flows along a slope of discarded ink when the mountain top of the discarded ink in the discarded-ink tank reaches a predetermined height. When the absorber absorbs the ink flowing along the slope of the discarded ink, the color of the absorber is changed. Then, as the color of the absorber is changed, the amount of light from or through the absorber is also changed so that the output value of an optical sensor is changed. Since the output value of the optical sensor is changed, it can be sensed that the height of the mountain top of the discarded ink in the discarded-ink tank reaches the predetermined height. Therefore, when the mountain top of the discarded ink in the discarded-ink tank does not protrude from a discarded ink entrance of the discarded ink-tank, the discarded-ink tank can be exchanged before the mountain top of the discarded ink in the discarded-ink tank protrudes from the discarded ink entrance of the discarded-ink tank by arranging the absorber at a location at which ink falling in the discarded-ink tank and flowing along the slope of the discarded ink can be absorbed. As a result, the contamination of the apparatus or the spill of the discarded ink from the discarded-ink tank at the time of exchange of the discarded-ink tank can be reduced.

Next, ink used for a printer according to the embodiment of the present invention is described below. Ink liquid used in the printer is a water-based ink having a high viscosity, which is caused by containing much coloring agent component. The water-based ink is obtained by further dispersing the coloring agent in a water-based dispersing system. The water-based ink has at least one of an ink surface tension equal to or less than 35 mN/cm and an ink viscosity equal to or greater than 5 mPa-sec at 25° C. When the ink surface tension of the ink liquid is equal to or less than 35 mN/cm, the penetration velocity of the ink into a paper can be increased. Also, when the ink viscosity at 25° C. is equal to or greater than 5 mPa-sec, ink excellent in a quick-drying property can be provided. Also, since it is difficult to blur, a sharp image can be obtained.

As a coloring agent, a hydrophobic dye or a pigment can be used, and an organic pigment and carbon black are particularly preferable.

As a dispersing system described above, a dispersing system containing polymer fine particles is preferable, in which as a polymer to be used, for example, vinyl polymers, polyester-type polymers, and polyurethane-type polymers can be provided. Among these polymers, the vinyl polymers are preferable.

Also, in order to make the ink surface tension of the ink liquid be equal to or less than 35 mN/cm, a wetting agent is added into the ink liquid used in the embodiment of the present invention. As a wetting agent, there can be provided glycerin, 1,3-butanediol, triethylene glycol, 1,6-hexanediol, propylene glycol, 1,5-pentanediol, diethylene glycol, dipropylene glycol, trimethylolpropane, and trimethylolethane, and at least one kind of them is added into the ink liquid.

Further, at least one of polyol or glycol ethers having from 8 to 11 carbon atoms, anionic surfactants and nonionic surfactants is added to the ink liquid according to the embodiment of the present invention.

As examples of them, 2-ethyl-1,3-hexanediol, 2,2,4-trimethyl-1,3-pentanediol, and the following substances with one of the structures (I) through (VII) can be provided.

$$R_1—O—(CH_2CH_2O)_mCH_2COOM \quad (I)$$

Herein, R1 is an alkyl group that has from 6 to 14 carbon atoms and may be branched, m is an integer of 3 through 12, and M is an alkali metal ion, a quaternary ammonium ion, a quaternary phosphonium ion, or a cation of alkanolamine.

$$\begin{array}{l} CH_2COO—R_2 \\ | \\ MO_3SCHCOO—R_2 \end{array} \quad (II)$$

Herein, $R_2$ is a branched alkyl group having from 5 to 16 carbon atoms and M is an alkali metal ion, a quaternary ammonium ion, a quaternary phosphonium ion, or a cation of alkanolamine.

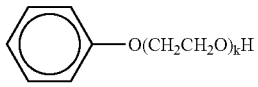

(III)

Herein, R is a carbon chain that has from 6 to 14 carbon atoms and may be branched and k is an integer of 5 through 20.

$$R—(OCH_2CH_2)_nOH \quad (IV)$$

Herein, R is a carbon chain that has from 6 to 14 carbon atoms and may be branched and k is an integer of 5 through 20.

$$H—(OCH_2CH_2)_m—(OCH(CH_3)CH_2)_n—R' \quad (V)$$

Herein, R is a carbon chain that has from 6 to 14 carbon atoms and both m and n satisfy a relationship of m,n≦20.

$$H—(OCH(CH_3)CH_2)_m—(OCH_2CH_2)_n—R' \quad (VI)$$

Herein, R is a carbon chain that has from 6 to 14 carbon atoms and both m and n satisfy a relationship of m,n≦20.

(VII)

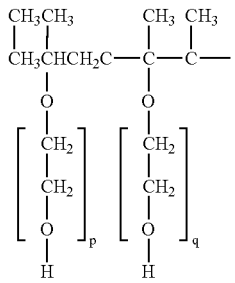

Herein, each of p and q is an integer of 0 through 40.

As a method of obtaining the ink liquid, preferable is a method including the steps of dissolving a polymer into an organic solvent, adding a pigment, water, a wetting agent, a surfactant, etc., kneading to obtain paste, diluting the paste with water according to need, and evaporating the organic solvent to obtain a water-based ink.

Some examples of the ink liquid are described below but the ink liquid is not limited to these examples.

EXAMPLE 1

(Cyan Ink)

An ink composition in accordance with the following formulation was prepared and adjusted using 10% aqueous solution of lithium hydroxide so that the PH was 9. Subsequently, filtration was made using a membrane filter with an average pore size of 0.8 μm so as to obtain an ink composition.

Phthalocyanine pigement-containing polymer fine particles: 10.0 wt % (as a solid content)

1,3-butanediol: 25.0 wt %

Glycerol: 8.5 wt %

Surfactant $CH_3(CH_2)_{12}O(CH_2CH_2O)_3CH_2COOH$: 2.0 wt %

2-ethyl-1,3-hexanediol: 1.8 wt %

Proxel LV (preservative): 0.1 wt %

Anti-foaming agent: 0.05 wt %

Ion-exchanged water: Balance

Thus, a polymer fine particle-containing water-based dispersed system which contains a phthalocyanine pigment was obtained as a C-color water-based ink liquid.

EXAMPLE 2

(Magenta Ink)

An ink composition was prepared similar to the cyan ink except the use of the following composition and the pH was adjusted to 9 using sodium hydroxide.

Dimethylquinacridone pigment containing polymer fine particles: 0.5 wt % (as a solid content)

1,3-butanediol: 22.0 wt %

Glycerol: 7.0 wt %.

Polyoxyalkylene derivative Dispanol TOC: 2.0 wt %

2-ethyl-1,3-hexanediol: 2.0 wt %

Proxel LV (preservative): 0.05 wt %

Anti-foaming agent: 0.1 wt %

Ion-exchanged water: Balance

Thus, a polymer fine particle-containing water-based dispersed system which contains a dimethylquinacridone pigment was obtained as a M-color water-based ink liquid.

EXAMPLE 3

(Yellow Ink)

An ink composition was prepared similar to the cyan ink except the use of the following composition and the pH was adjusted to 9 using lithium hydroxide.

Mono-azo yellow pigment containing polymer fine particles: 10.0 wt % (as a solid content)

1,3-butanediol: 23.5 wt %

Glycerol: 7.5 wt %

Polyoxyalkylene derivative Dispanol TOC: 2.0 wt %

2-ethyl-1,3-hexanediol: 2.0 wt %

Proxel LV (preservative): 0.05 wt %

Anti-foaming agent KM72F: 0.1 wt %

Ion-exchanged water: Balance

Thus, a polymer fine particle-containing water-based dispersed system which contains a mono-azo yellow pigment was obtained as a Y-color water-based ink liquid.

EXAMPLE 4

(Black Ink)

An ink composition was prepared similar to the cyan ink except the use of the following composition and the pH was adjusted to 9 using sodium hydroxide.

Dispersed liquid of carbon black treated with a diazo compound: 10.0 wt %

1,3-butanediol: 22.5 wt %

Glycerol: 7.5 wt %

N-methyl-2-pyrolidone: 2.0 wt %

Surfactant $CH_3(CH_2)$ 120 $(CH_2CH_2O)_3CH_2COOH$: 2.0 wt %

2-ethyl-1,3-hexanediol: 2.0 wt %

Proxel LV (preservative): 0.2 wt %

Anti-foaming agent: 0.1 wt %

Ion-exchanged water: Balance

Thus, a polymer fine particle-containing water-based dispersed system which contains carbon black was obtained as a Bk-color water-based ink liquid.

The properties of the obtained ink compositions are shown in Table 1.

TABLE 1

| | Surface tension (mN/m) (25° C.) | Viscosity (mPa · s) (25° C.) |
|---|---|---|
| Cyan | 32.1 | 8.3 |
| Magenta | 31.2 | 8.0 |
| Yellow | 31.6 | 7.90 |
| Black | 29.7 | 8.66 |

When an image was formed on a normal paper using the ink compositions described above, a good image could be obtained without character blurring or color border blurring. Particularly, recording could be made with smooth and natural reproduction of oblique lines and curved lines of complex Chinese characters. Further, although the viscosities of the ink compositions were high, stable printing characteristics were reproduced without nozzle clogging even when the ink compositions had been left to stand for approximately 2 through 3 days.

As described above, the present invention can be applied to an image forming apparatus including a head part with an ejection port configured to eject ink and a discarded-ink tank configured to collect ejected or absorbed ink in order to restore a function of the ejection port.

The present invention is not limited to the specifically disclosed embodiment(s), and variations and modifications may be made without departing from the scope of the present invention.

The present application is based on Japanese priority application No. 2005-038703 filed on Feb. 16, 2005, the entire contents of which are hereby incorporated by reference.

What is claimed is:

1. An image forming apparatus comprising:

a head part with an ejection port configured to eject ink;

a discarded-ink tank configured to collect ejected or absorbed ink in order to restore a function of the ejection port; and a sensing device configured to sense the discarded ink collected in the discarded-ink tank, the sensing device including an absorber configured to absorb the ink and an optical sensor configured to sense light received from the absorber; wherein:

the apparatus uses ink having a characteristic such that the discarded ink is accumulated in a mountain-like shape in the discarded-ink tank, and the absorber is arranged at a location, at which discarded ink can be absorbed when a mountain top of the discarded ink accumulated in a mountain-like shape reaches a predetermined height so that the discarded ink flows along a slope of the discarded ink accumulated in a mountain-like shape to the absorber.

2. The image forming apparatus as claimed in claim 1, wherein the optical sensor senses the light reflected from the absorber.

3. The image forming apparatus as claimed in claim 1, wherein the optical sensor senses the light transmitted through the absorber.

4. The image forming apparatus as claimed in claim 1, wherein the absorber has a substantially rectangular parallelepiped shape and exposes only a face of a smallest surface area of the absorber to an inside of the discarded-ink tank.

5. The image forming apparatus as claimed in claim 1, wherein at least a lower end portion of a side face of the absorber and an end portion of a bottom face of the absorber, both faces of which face the discarded ink accumulated in the mountain-like shape, are exposed to an inside of the discarded-ink tank.

6. The image forming apparatus as claimed in claim 1, wherein:

the sensing device has a holding member configured to hold the absorber and the optical sensor such that there is a predetermined distance between the absorber and the optical sensor; and the holding member includes a cover that covers a space existed between the absorber and the optical sensor.

7. The image forming apparatus as claimed in claim 1, wherein the ink is a water-based ink comprising a pigment and a solvent in which at least one of a wetting agent and a penetrating agent is contained in water, and a viscosity of the ink at 25° C. is equal to or greater than 5 mPa·sec.

* * * * *